United States Patent [19]

Gustavsson

[11] 4,143,628

[45] Mar. 13, 1979

[54] METHOD AND MEANS FOR INCREASING THE MEAN EFFICIENCY OF AN OTTO CYCLE ENGINE

[75] Inventor: Erik A. Gustavsson, Skarblacka, Sweden

[73] Assignee: Skarblacka Bil- & Motor AB, Skarblacka, Sweden

[21] Appl. No.: 770,654

[22] Filed: Feb. 22, 1977

[30] Foreign Application Priority Data

Feb. 24, 1976 [SE] Sweden ..... 7602179

[51] Int. Cl.[2] ..... F02B 75/04

[52] U.S. Cl. ..... 123/78 A; 123/48 A

[58] Field of Search ..... 123/48 R, 48 A, 48 AA, 123/78 R, 78 A

[56] References Cited

U.S. PATENT DOCUMENTS

| | | | |
|---|---|---|---|
| 1,243,522 | 10/1917 | Hillhouse | 123/78 A |
| 1,373,862 | 4/1921 | Buonocore et al. | 123/78 A |
| 1,639,477 | 8/1927 | Wilson | 123/48 AA |
| 1,805,540 | 5/1931 | Brown | 123/78 A |
| 1,812,572 | 6/1931 | Talbot | 123/48 AA |
| 2,142,621 | 1/1939 | Tsuneda | 123/48 AA |
| 2,145,017 | 1/1939 | Tsuneda | 123/48 AA |
| 2,467,568 | 4/1949 | Rosaen | 123/48 AA |

*Primary Examiner*—Charles J. Myhre
*Assistant Examiner*—David D. Reynolds
*Attorney, Agent, or Firm*—Neil F. Markva

[57] ABSTRACT

For improving the efficiency of an Otto cycle engine operating under varying loads, an opposing piston is provided above the driving piston in each cylinder and is controlled in accordance with the inlet manifold depression so as to vary the compression ratio and maintain the compression substantially constant with different working loads.

6 Claims, 4 Drawing Figures

METHOD AND MEANS FOR INCREASING THE MEAN EFFICIENCY OF AN OTTO CYCLE ENGINE

BACKGROUND OF THE INVENTION

This invention concerns the problem with Otto engines that under conditions of partial loading poorer fuel efficiency is obtained and, in addition, the content of undesirable gases, carbon monoxide, unburnt hydrocarbons and oxides of nitrogen in the exhaust gases increases.

SUMMARY OF THE INVENTION

The present invention proposes a solution for the above problem in which the compression ratio of the cylinders is varied such that the compression will remain essentially the same with different loads. This is achieved by means of movable opposing pistons which are mounted above the driving pistons in such a way that they may be moved in relation to the depression in the inlet manifold of the engine.

More specifically, this invention is directed to a method of increasing the mean efficiency of an Otto cycle engine having a driving piston movably disposed within a cylinder. The method comprises the steps of providing an opposing piston within the cylinder above the driving piston to define a delimited compression chamber above the top and outermost position of the driving piston. The volume of the compression chamber is varied cyclically with a frequency fixedly interrelated to the working cycle of the engine. The volume is varied with an amplitude interrelated to the load under which the engine is operating. The varying step is effected to vary the compression ratio to cause the compression to remain substantially the same with different loading of the engine.

Another feature of the invention is directed to an assembly for increasing the mean efficiency of an Otto cycle engine having at least one cylinder with a driving piston movably disposed therein. The assembly comprises an opposing piston mounted in the cylinder to define a delimited compression chamber above the top and outermost position of the driving piston. Control means are effective to control the movement of the opposing piston within the cylinder with respect to the depression in the inlet manifold of the Otto cycle engine. The control means includes means for varying the volume of the compression chamber cyclically with a frequency fixedly interrelated to the working cycle of the engine and with an amplitude interrelated to the load under which the engine is operating. The varying means is effective to vary the compression ratio causing the compression to remain substantially the same with different loading of the engine.

A further feature of the invention is directed to the specific structure formed by the varying elements of the assembly control means. The more specific embodiment of the control means includes a pneumatic servo having a pressure chamber connected to the inlet manifold of the Otto cycle engine. The control means includes a connecting rod hinged to the opposing piston and a control rod connected to the servo to tilt the connecting rod in response to changing pressure in the pressure chamber. The control means further includes a cam member and a cam follower. The cam member has a slot movably containing the cam follower and is pivotally mounted at one end thereof nearest to the servo. The free end of the connecting rod is attached to the cam follower which is located in said cam slot. The cam member is pivotally mounted on a pin which is rigidly fixed to the cylinder of the Otto cycle engine. The control means also includes a cam member operating mechanism effective to swing the other end of the cam member in a direction forwards and backwards with respect to the opposing piston.

BRIEF DESCRIPTION OF DRAWINGS

The invention is further elucidated by the following description and drawings showing.

DESCRIPTION OF SPECIFIC EMBODIMENTS

Figure 1:
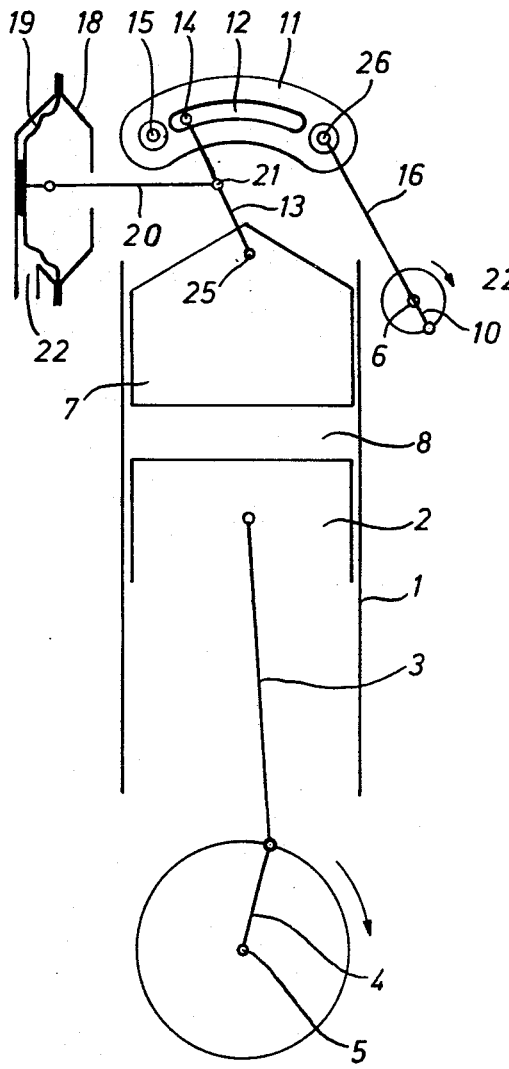
FIG. 1 is a schematic sectional view of the position of the control mechanism at the beginning of the induction stroke under low load, in one form of an engine constructed in accordance with the invention.
Figure 2:
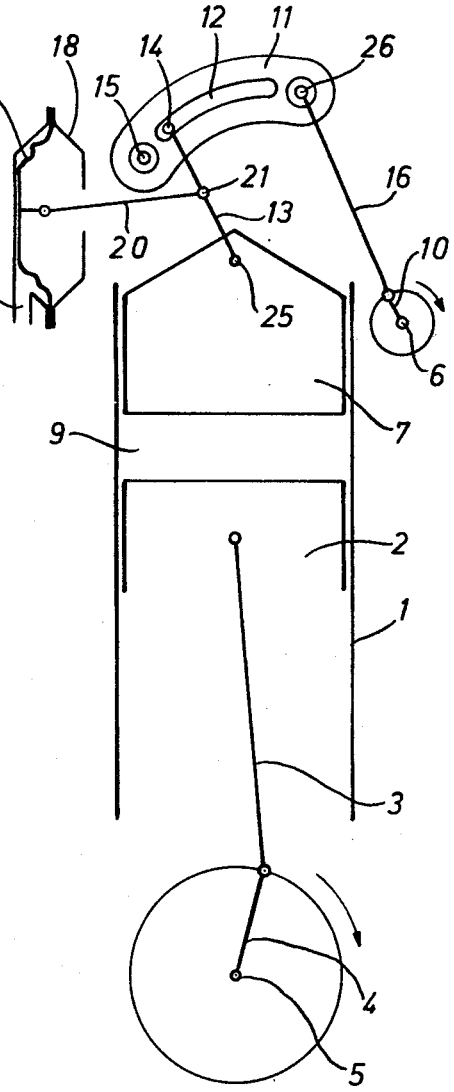
FIG. 2 is a schematic sectional view of the same mechanism at the beginning of the power stroke under low load.
Figure 3:
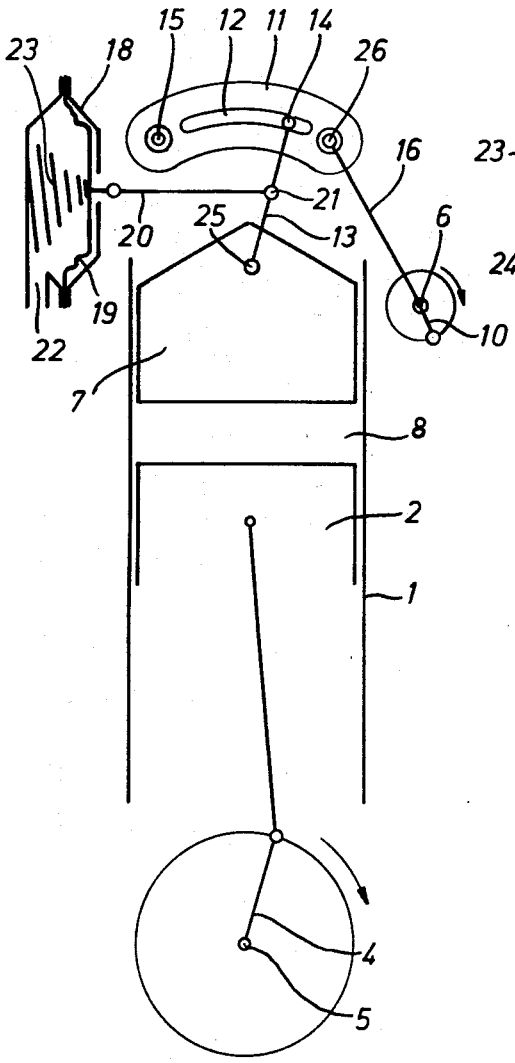
FIG. 3 is a schematic sectional view of the same mechanism at the beginning of the induction stroke under high load.
Figure 4:
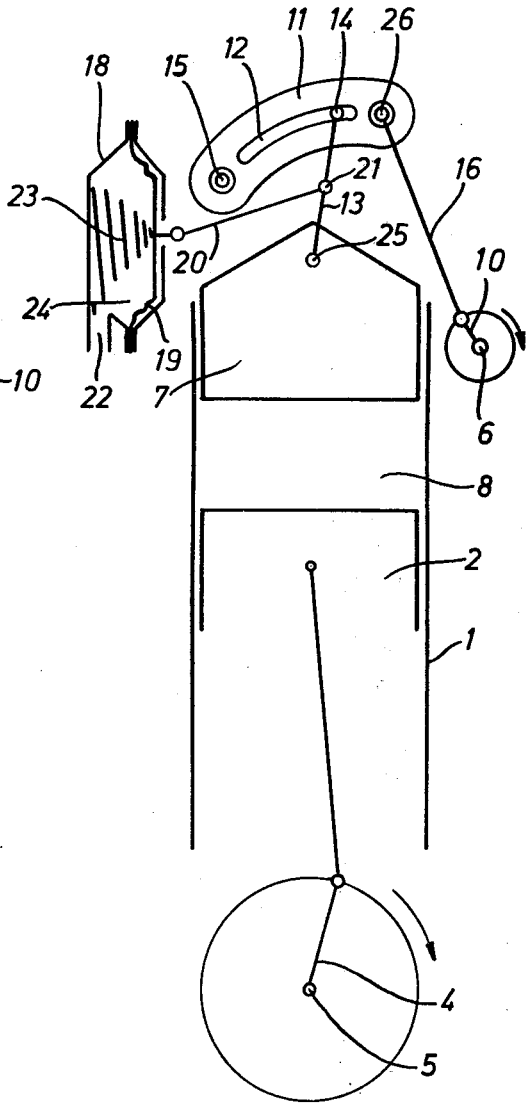
FIG. 4 is a schematic sectional view of the same mechanism at the beginning of the power stroke under high load.

The engine shown in FIGS. 1 to 4 comprises a cylinder 1 with a piston 2, connecting rod 3 and a crank 4 on a crankshaft 5. A camshaft 6 is arranged to open and close the inlet and exhaust valves in the normal manner and is not shown in further detail. An opposing piston 7 is mounted in the cylinder 1 above the driving piston 2 and it can be moved towards or away from the driving piston 2 to create the working space 8, 9 in the cylinder. The camshaft 6 is equipped with a crank 10 which is attached to a connecting rod 16 by means of a bearing.

The other end of connecting rod 16 is attached by means of a bearing to a slide, or cam member 11, which can rotate about a pin 15, and includes a longitudinal, curved slot 12. A cam follower roller 14 on a rod 13 which is attached to opposing piston 7, by a hinged joint at 25, runs in slot 12. The rod 13 is tilted by a servo comprising a case 18 containing a spring-loaded diaphragm 19 which responds to the pressure in the inlet manifold 22. The diaphragm 19 is attached to rod 13 by way of another link rod 20 and pivot joint 21.

In operation, crank 10 brings about a backward and forward movement of the slide 11 about pin 15 by means of rod 16. As is evident from the drawing, this movement will also cause opposing piston 7 to move upwards and downwards because of the rod 13. The stroke of opposing piston 7 is controlled by said servo. When roller 14 is near pin 15 as in FIGS. 1 and 2, the stroke of piston 7 is short. However, when roller 14 is at some distance from pin 15, as in FIGS. 3 and 4, the stroke of piston 7 is long.

Therefore, with a low load on the engine, i.e., low pressure in the inlet manifold 22, the working space 8, 9 changes relatively little. With a high load, the pressure in the inlet manifold 22 and in the pressure chamber 24 defined within the servo case 18 increases and diaphragm 19 is moved in response thereto against the tension of its spring 23. Consequently, roller 14 is correspondingly moved such that the stroke of the opposing piston 7 increases thereby also increasing the pressure difference between the induction stroke and the power stroke. Thus, the increased stroke of piston 7 causes the difference in compression with varying load to be countered.

While the method and means for increasing the mean efficiency of an Otto cycle engine has been shown and described in detail, it is obivous that this invention is not to be considered as being limited to the exact form disclosed, and that changes in detail and construction may be made therein within the scope of the invention, without departing from the spirit thereof.

I claim:

1. A method of increasing the mean efficiency of an Otto cycle engine having a driving piston movably disposed within a cylinder, said method comprising the steps of:

a. providing an opposing piston within said cylinder above the driving piston to define a delimited compression chamber above a top and outermost position of the driving piston, and b. varying the volume of said compression chamber cyclically with a frequency fixedly interrealted to the working cycle of the engine and with an amplitude interrelated to the load under which the engine is operating, c. said varying step being effective to vary the compression ratio causing the compression to remain substantially the same with different loading of said engines, d. the opposing piston executes a motion controlled by the motion of the driving piston, e. the movement of the opposing piston is controlled such that the effective working space in the cylinder is a minimum and has a constant volume at the beginning of the induction stroke for any load.

2. An assembly for increasing the mean efficiency of an Otto cycle engine having at least one cylinder with a driving piston movably disposed therein, said assembly comprising:

a. an opposing piston mounted in the cylinder to define a delimited compression chamber above the top and outermost position of the driving piston, b. control means for controlling the movement of the opposing piston within the cylinder, c. said control means including means for varying the volume of said compression chamber cyclically with a frequency fixedly interrelated to the working cycle of the engine and with an amplitude interrelated to the load under which the engine is operating, d. said varying means being effective to vary the compression ratio causing the compression to remain substantially the same with different loading of said engine, e. the control means includes a pneumatic servo having a pressure chamber connected to the inlet manifold of said engine, f. said control means including a connecting rod hinged to the opposing piston and a control rod connected to the servo to tilt said connecting rod in response to changing pressure in said pressure chamber, g. said control means further including a cam member and a cam follower, h. said cam member having a slot movably containing said cam follower and being pivotally mounted at one end thereof nearest to the servo, i. the free end of said connecting rod being attached to said cam follower in said cam slot, j. said cam member being pivotally mounted on a pin which is rigidly fixed to the cylinder, k. said control means further including a cam member operating mechanism effective to swing the other end of the cam member in a direction forwards and backwards with respect to the opposing pistons.

3. An assembly as defined in claim 2 wherein the cam member operating mechanism comprises a pivot joint at the free end of the cam member, a rotatable crank mechanism and a second connecting rod attached at one end thereof to the pivot joint and at the opposite end thereof to the crank mechanism, said crank mechanism being effective to rotate at a speed which is exactly half that of the crankshaft which operates the driving piston.

4. An assembly as defined in claim 3 wherein the crank mechanism is mounted on a shaft and is effective to cause the cam member to take up a position nearest the opposing piston at the beginning of the induction stroke and a position furthest from the opposing piston at the point of ignition of the Otto cycle engine.

5. An assembly as defined in claim 2 wherein the servo is effective to move the cam follower towards the end of the slot nearest the pivot mounting pin when the engine is idling and towards the end of the slot which is the furthest from the pivot mounting pin when the engine is fully loaded.

6. An assembly as defined in claim 2 wherein the cam slot forms an arc of a circle, and when the cam member is nearest the opposing piston the center of the arc coincides with the hinge connecting joint of the connecting rod to the opposing piston.

* * * * *